United States Patent [19]

Eskeli

[11] 3,937,034

[45] Feb. 10, 1976

[54] GAS COMPRESSOR-EXPANDER

[76] Inventor: Michael Eskeli, 7994-41 Locke Lee, Houston, Tex. 77042

[22] Filed: Mar. 7, 1974

[21] Appl. No.: 448,818

Related U.S. Application Data

[63] Continuation-in-part of Ser. Nos. 399,199, Sept. 20, 1973, abandoned, and Ser. No. 405,584, Oct. 11, 1973.

[52] U.S. Cl. ..... 62/401; 126/247; 165/86; 415/1; 415/64; 415/178; 416/96 R

[51] Int. Cl.[2] ..... F25B 3/00

[58] Field of Search ..... 62/86, 87, 401, 402, 499; 122/26; 126/247; 165/86, 88; 415/1, 64, 114, 177, 178, 179, 199 A; 416/95, 96

[56] References Cited

UNITED STATES PATENTS

| | | | |
|---|---|---|---|
| 1,183,939 | 5/1916 | Whittelsey | 122/26 |
| 2,522,781 | 9/1950 | Exner | 62/499 |
| 2,529,765 | 11/1950 | Exner | 62/499 |

FOREIGN PATENTS OR APPLICATIONS

| | | | |
|---|---|---|---|
| 633,985 | 6/1937 | Germany | 62/401 |

*Primary Examiner*—Albert W. Davis, Jr.
*Assistant Examiner*—Sheldon Richter

[57] ABSTRACT

A method and apparatus for compressing and expanding a fluid by passing said fluid through a rotating continuous flow centrifuge wherein said fluid is pressurized by centrifugal action on said fluid by said centrifuge rotor. Said rotor is provided with passageways for said fluid with vanes placed therewithin assuring that the fluid will rotate with said rotor. After compression, said fluid is passed in compressed state through nozzles near the periphery of said rotor with said nozzles oriented to discharge said fluid backward thus reducing the absolute tangential velocity of said fluid. After passing said nozzles, said fluid is passed through inward extending passageways to exit near the rotor center. Cooling is provided for said fluid during said compression, and heating is provided during expansion in said inward extending passages. As an alternate, two rotors may be employed, wherein said fluid is passed to a second rotor for said expansion and for deceleration. Work is required by said fluid during said compression and acceleration, and work is produced by said fluid during said expansion.

1 Claim, 5 Drawing Figures

GAS COMPRESSOR-EXPANDER

This application is a continuation-in-part application of "Rotary Pressurizer," filed 9-20-73, Ser. No. 399,199, now abandoned and "Compressing Centrifuge," filed 10-11-73, Ser. No. 405,584.

This invention relates to devices for compressing and expanding gases from a lower pressure to a higher pressure by employing a continuous flow centrifuge with outward extending passages at the compressing section and then having inward extending fluid passages for expansion and for deceleration of said fluid.

In my previous U.S. Pat. Nos. 3,761,195 and 3,793,848, I described similar compressors; the compressor-expander of this invention adds some improvements intended to reduce the work input to the compressor-expander.

It is an object of this invention to provide a means for adding heat to the fluid which is the first fluid, during expansion and deceleration within the centrifuge, for reduced work input to said compressor-expander.

Figure 1:
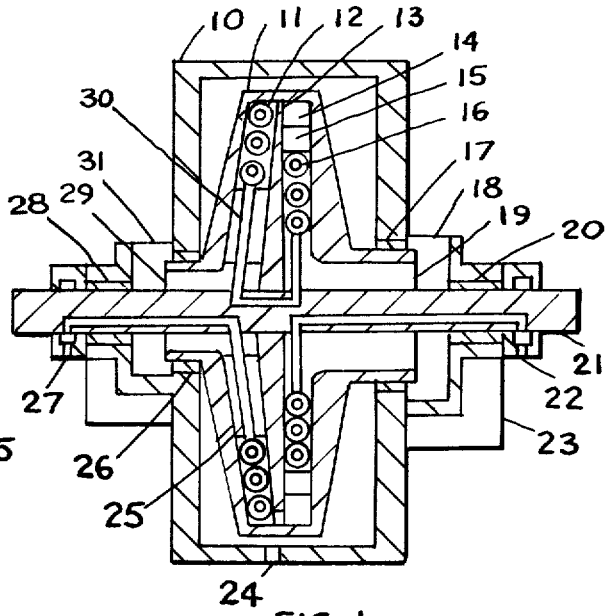
FIG. 1 is a cross section of one form of the compressor.

Referring to FIG. 1, therein is shown a cross section of one form of the compressor-expander. 10 is casing, 11 is rotor, 12 is heat removal heat exchanger, 13 are rotor nozzles oriented to discharge said first fluid backward away from the direction of rotation, 14 is first fluid space, 15 are vanes within the first fluid expansion passage, 16 is heat addition heat exchanger, 17 and 26 are rotor seals, 18 and 19 are first fluid exits, 20 and 28 are shaft bearings, 21 is rotor shaft, 22 and 27 are second fluid inlet and outlet, 23 is bearing support, 24 is casing vent into which a vacuum pump may be connected, 25 is second fluid distribution conduit, 29 and 31 are first fluid entries, 30 is a vane within outward first fluid passage.

Figure 2:
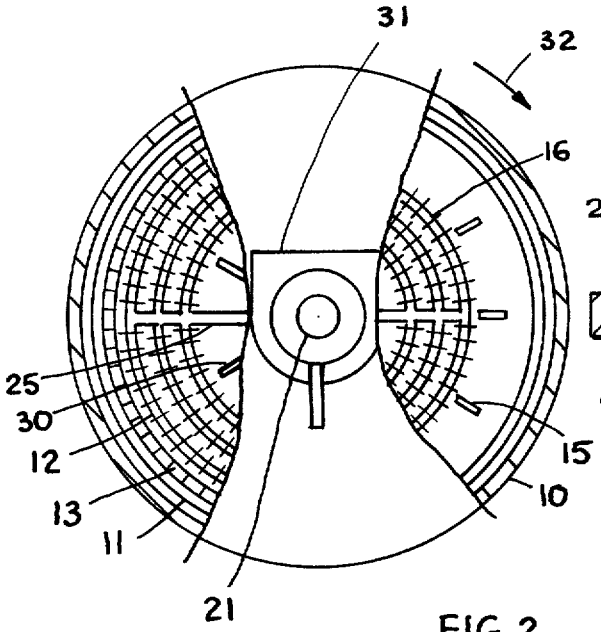
FIG. 2 is an end view of the unit shown in FIG. 1.

In FIG. 2, an end view of the unit shown in FIG. 1, is illustrated. 10 is casing, 15 is a vane, 16 is heat addition heat exchanger, 32 indicates direction of rotation, 31 is first fluid inlet, 25 is second fluid conduit, 30 is vane, 12 is heat removal heat exchanger, 13 are rotor nozzles, 11 is rotor, and 21 is rotor shaft.

Figure 3:
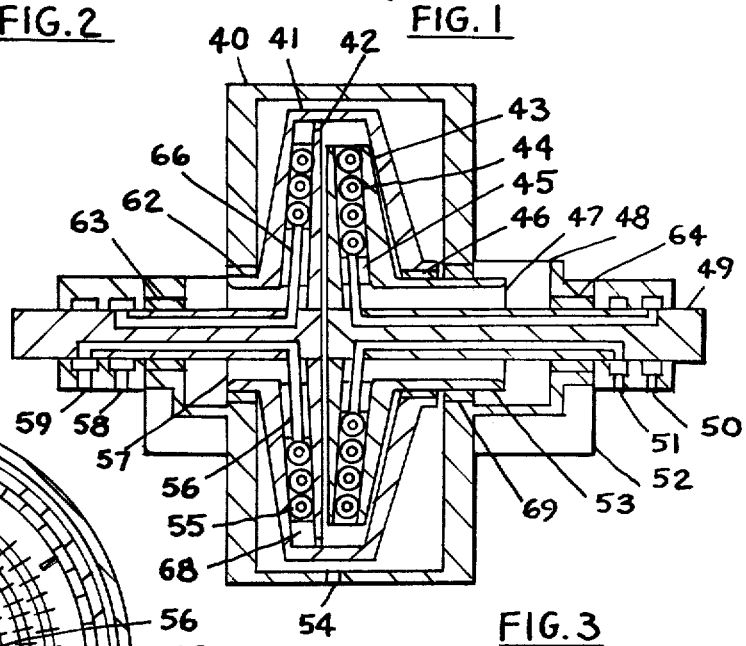
FIG. 3 is a cross section of another form of the compressor.

In FIG. 3, another form of the compressor-expander is shown, in cross section. 40 is casing, 41 is first rotor, 42 are first rotor nozzles, 43 is second rotor, 44 is heat addition heat exchanger, 45 is vane, 46 is a bearing and seal, 47 and 48 are fluid exits, 64 and 63 are bearings and seals, 49 is first rotor shaft, 50 and 51 are third fluid entry and exit, 52 is bearing support, 53 is second rotor shaft supported by bearing and seal 68, 54 is casing vent, into which a vacuum pump may be connected, 68 is a vane, 55 is heat removal heat exchanger where second fluid is being circulated in heat exchange relationship with said first fluid, 56 is second fluid distribution conduit, 57 and 61 are first fluid inlets, 58 and 59 are second fluid inlet and outlet, 62 is rotor seal, and 66 are vanes.

Figure 4:
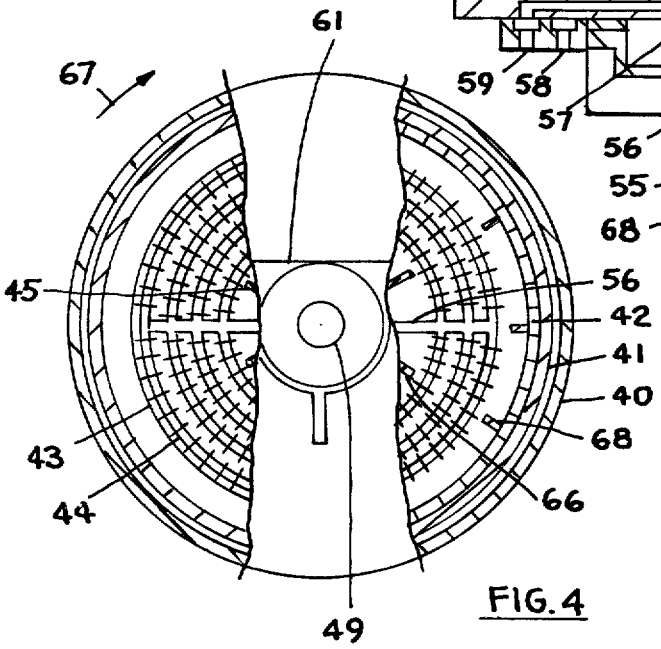
FIG. 4 is an end view of the unit shown in FIG. 3.

In FIG. 4, an end view of the unit shown in FIG. 3 is illustrated. 40 is casing, 41 is first rotor, 42 are first rotor nozzles, 56 is second fluid conduit, 61 is first fluid entry, 67 indicates direction of rotation for both rotors, 43 is second rotor, 44 is heat addition heat exchanger wherein said third fluid is circulated in heat exchange relationship with said first fluid, 45 are vanes, 49 is shaft, 66 are vanes, 68 are vanes.

Figure 5:
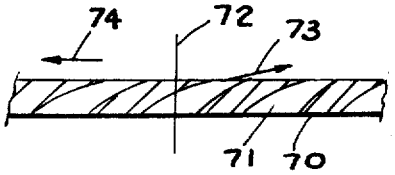
FIG. 5 is a detail of the rotor nozzles.

In FIG. 5, a detail of the rotor nozzles is shown. 70 is rotor wall into which nozzles 71 are mounted, 72 indicates orientation of rotor shaft about which said rotor rotates in direction indicated by 74, and 73 indicates first fluid leaving nozzles 71.

In operation, and referring to FIG. 1, first fluid enters via opening 31 and enters rotor 11 via opening 29, and is then compressed within rotor outward extending passageways with vanes and heat exchanger fins assuring that said first fluid will rotate with said rotor. During said compression, heat is removed from said first fluid in heat exchanger 12, wherein a second fluid is circulated in heat exchange relationship with said first fluid. After said compression, said first fluid is discharged from nozzles 13 backward in a direction that is away from the direction of rotation thus reducing the absolute tangential velocity of said first fluid. Said first fluid is then decelerated and expanded in inward extending first fluid passageways with vanes and heat exchanger fins assuring that said first fluid will rotate with said rotor for recovery of work associated with said deceleration of said first fluid. After said deceleration, first fluid is discharged via opening 19, and opening 18.

The operation of the unit shown in FIG. 3 is similar to that described for the unit of FIG. 1. After discharge from the nozzles 42, the first fluid is passed to a second rotor inward extending passageways for deceleration and expansion and for recovery of work associated with said fluid deceleration. After said deceleration, said first fluid is passed to exit opening 47. Heat is added to said first fluid in heat exchanger 44 wherein a third fluid is being circulated in heat exchange relationship with said first fluid.

In the unit of FIG. 1, heat is added to said first fluid in heat exchanger 16, where said second fluid may be circulated in heat exchange relationship with said first fluid; usually, said second fluid is first passed through said heat removal heat exchanger 12, and then passed to said heat addition heat exchanger 16.

In the unit of FIG. 3, said second fluid may be passed to heat exchanger 44 and used as said third fluid. Also, in the unit of FIG. 1, a third fluid may be employed in heat exchanger 16, as desired.

The work input to the compressor of this invention is the difference between the work used to accelerate said first fluid to the rotor tangential velocity, and the work recovered from said first fluid during said expansion and deceleration. Heat removal during compression and acceleration reduces the first fluid density and thus results in a higher first fluid pressure at rotor periphery for a predetermined rotor rotational speed. Heat addition during expansion and deceleration will result in a reduced first fluid density, and thus a lesser pressure loss in said deceleration, for a predetermined rotor tangential speed. Normally, said compression of said first fluid is nearly isothermal, depending of second fluid entry temperature, and similarly, the expansion of said first fluid may be isothermal, depending of the temperature of the heat addition fluid in heat exchangers 44 and 16. Thus, very low work input to said compressor results.

Said second fluid and said third fluid are passed to said heat exchangers through passageways within said rotor shafts, and thus the work requirement for said fluids is nearly nil.

The first fluid is normally gas, being compressed to a higher pressure, such as air. Said second fluid and said third fluid are usually liquids, such as water, but gases also can be used if desired.

Various gauges and governors may be used with the compressor of this invention. They do not form a part of this invention and are not further described herein.

The rotating components of the compressor are normally made of high strength materials, usually metals. The heat exchangers are shown to be made of finned tubing, but other materials may be used, or the heat exchangers built to rotor walls. Vanes are provided to assure that the first fluid will rotate with the rotor, and the heat exchanger fins also serve as said vanes.

The unit shown in FIG. 1 has a single rotor, with the first fluid being discharged from nozzles 13 backward, and then the vane 15 tips are intented to have approximately the same tangential velocity as the first fluid entering the spaces between said vanes 15. Many fluids, especially gases with high viscosity, may be accelerated by the rotor 11 in space 14, thus making it difficult to obtain the desired tangential velocity reduction for said first fluid. This difficulty is provided for in the unit of FIG. 3, where a second rotor may rotate at any desired speed, thus assuring that the first fluid tangential velocity after leaving nozzles 42 is maintained at a value required for best performance.

I claim:

1. In a compressor-expander having two rotating rotors with a fluid to be compressed being the first fluid, with a first rotor having an entry for said first fluid near the center of rotation with said first fluid then being accelerated and compressed in outward extending first rotor passages and said first fluid then being passed into a second rotor for deceleration and expansion, and to exit near the center of rotation of said second rotor, with heat being removed from said first fluid in a heat removal heat exchanger within said first rotor outward passages by circulating a second fluid in heat exchange relationship with said first fluid, the improvement comprising:

a. a heat addition heat exchanger within said inward extending second rotor first fluid passages for adding heat to said first fluid during said expansion and deceleration, by circulating a third fluid in heat exchange relationship with said first fluid, with a third fluid being supplied and discharged via passages carried by said second rotor.

* * * * *